US006209245B1

(12) United States Patent
Wittenberg

(10) Patent No.: US 6,209,245 B1
(45) Date of Patent: Apr. 3, 2001

(54) SIGN DISPLAY ATTACHMENT SYSTEM

(76) Inventor: Ron L. Wittenberg, 17212 N. Scottsdale Rd., Scottsdale, AZ (US) 85255

( * ) Notice: Subject to any disclaimer, the term of this patent is extended or adjusted under 35 U.S.C. 154(b) by 0 days.

(21) Appl. No.: 09/473,256

(22) Filed: Dec. 27, 1999

Related U.S. Application Data

(63) Continuation-in-part of application No. 09/305,861, filed on May 5, 1999, which is a continuation-in-part of application No. 08/868,624, filed on Jun. 4, 1997, now abandoned, and a continuation-in-part of application No. PCT/US98/11447, filed on Jun. 1, 1998.

(51) Int. Cl.[7] ..... G09F 17/00
(52) U.S. Cl. ..... 40/603; 40/590; 160/378
(58) Field of Search ..... 40/590, 603, 604; 160/328, 378; 38/102.1, 102.91

(56) References Cited

U.S. PATENT DOCUMENTS 5,033,216 * 7/1991 Gandy et al. ..... 40/603
5,142,804 * 9/1992 Hillstrom et al. ..... 40/603
5,467,546 * 11/1995 Kovalak, Jr. ..... 40/603
5,678,338 * 10/1997 Coleman ..... 40/603
5,893,227 * 4/1999 Johansson et al. ..... 40/603
6,073,376 * 6/2000 Verret ..... 40/603

* cited by examiner

*Primary Examiner*—Brian K. Green
(74) *Attorney, Agent, or Firm*—Frank J. McGue

(57) ABSTRACT

A signage display attachment system is disclosed for mounting a sign to a substrate. The signage display attachment system comprises an insertion bead, the insertion bead having two elongated legs extending from a base. The two elongated legs define a narrow, elongated un-shaped channel therebetween whereby the edge of a sign is captured within the channel. The insertion bead further has an upper prong and a lower prong extending laterally from the base perpendicular to the legs, the upper prong and the lower prong having a slot therebetween. A mounting channel has a plurality of recesses on one side thereof with the upper prong and the lower prong being sized to be receivable in combination within one of the plurality of recesses. The system releasably retains the upper prong and the lower prong, in combination, within each of the plurality of recesses. An L-shaped mounting channel having a retainer leg and a base is also provided. The base is separated by the width of the channel insert, in combination, when the prongs are inserted into one of the plurality of recesses. The channel insert is releasably retained between a substrate and the retaining leg.

5 Claims, 7 Drawing Sheets

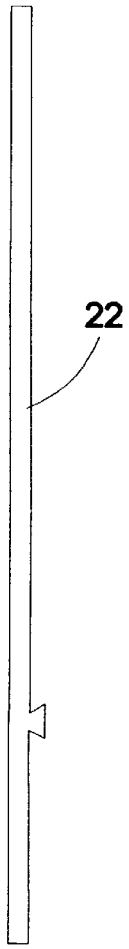
F.IG. 8A
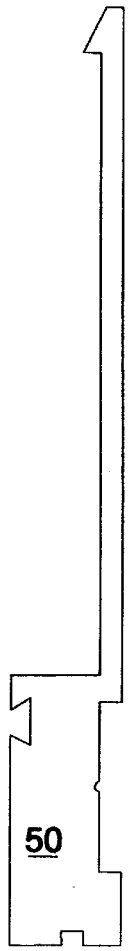
F.IG. 8B
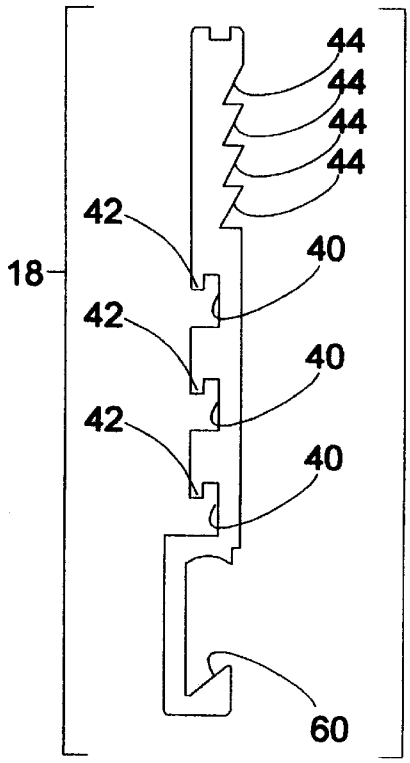
F.IG. 8C
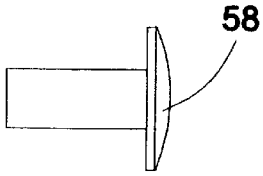
F.IG. 8D
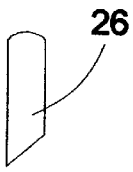
F.IG. 8E
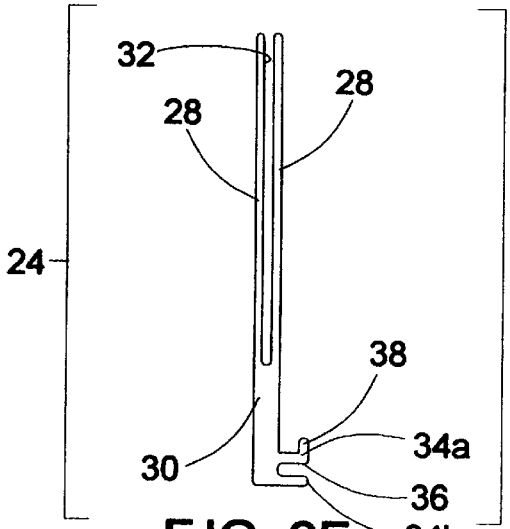
F.IG. 8F

SIGN DISPLAY ATTACHMENT SYSTEM

CROSS REFERENCE TO RELATED APPLICATIONS

The present application is a continuation-in-part of application Ser. No. 09/305,861 filed May 5, 1999, now pending, which is a continuation-in-part of prior U.S. application Ser. No. 08/868,624 filed Jun. 4, 1997, now abandoned, priority from the filing date of which is hereby claimed under 35 U.S.C. §120 and is a continuation-in-part of prior PCT application serial number PCT/US9811447 filed Jun. 1, 1998.

BACKGROUND OF THE INVENTION

This invention relates to an attachment system or process for mounting flexible, easily replaceable advertising displays on to the side of a vehicle, such as a truck, tractor trailer, or van or fixed billboards or signs of various sizes.

There have been developed a number of methods for displaying advertising signage on the side of moving vehicles. Given the increased mobility of the public, and the growing unsatisfied demand for fixed roadside signage, the mobile billboard, achieved by mounting advertising art to the side of a transport vehicle, is becoming ever more common, and ever more practical, given advances in the technology of printing such advertising art, allowing better color quality, as well as much greater pixel resolutions. Taken together, these factors now make mobile, lateral surface of transport vehicle, advertising a higher quality and more sought after mode of commercial publicity than ever before. With the development of the science of mobile commercial publicity production, one would expect a corresponding development and sophistication in the technology of mounting said media to their substrate, the lateral sides of transport vehicles. This invention is a new step in said development and sophistication.

There are a number of constraining factors in designing a mobile advertising mounting system, some regulatory, others aesthetic, some physical. First, there exist federal as well as state transportation regulations restricting the width of transport vehicles to an upper limit of 102 inches. Secondly, transport advertising is most often procured by leasing the use of a carrier's fleet for such purpose. The fleet owner is inclined to lease to the advertising broker whose system impacts the lest on the fleet's vehicles, in terms of time required for initial setup of the system, turnaround time for installation/replacement of a particular image, and complexity of the permanent hardware attached to the vehicle. Further, in order to maintain the planar aspect of the sign, which is critical to readability from afar, the current industry practice is to apply tension to the signage. Finally, such signs need to present a minimal profile to avoid damage from abrasion or to enhance he safety of the design.

This has been accomplished in a vareity of ways, such as the systems described in U.S. Pat. Nos. 5,239,765 and 5,507,109. The first of these two systems relies on a series of anchors placed along the top and bottom of the lateral sides of the vehicle. A flat rectangular rod has the edges of the signage wrapped around it on the top and bottom edges of the sign, and this wrapping is held by the rows of anchors. The series of anchors method presents obvious difficulties as far as bringing the individual anchors within the top or bottom row into perfect linear alignment, and there are also issues of significant protrusion from the side of the vehicle, using this system, which may violate state and federal regulatory restrictions.

Additionally, this system of U.S. Pat. No. 5,239,765 has no mechanism to prevent the signage material acting as an airfoil, billowing and tending to pull away from the vehicle, or, at the very least, assuming a convex shape, thus distorting the image. This system further has no vertical or lateral adjustability to account for variation in manufacture of the signage material or system installation.

U.S. Pat. No. 5,507,109 solves some of the problems with the system described in the earlier patent, yet it discloses a system that is visually asymmetric as well as possessing a mech larger footprint. This implementation also requires attaching a structural element to the signage using a rod in a pocket of the sign on the leading and top edges. Holes are ringed by grommets on reinforced flaps which must be sewn to the trailing and bottom edges of the sign thus decreasing the available area of the sign that can be used for displaying the image. Shock cords are attached to the grommets and the shock cords are attached to the truck wall by means of S hooks connected to either flanges which run along the bottom and top edges of the sides of most trailers or by holes drilled in the sides of the trailer.

What is desired is a visually symmetric, simple, durable sign comprised of a small number of parts, and specially engineered to impact the truck or trailer at a minimum in terms of fasteners per foot required to the truck or trailer siding, as well as insulating the truck or trailer interior from moisture, system of attaching signage to a transport vehicle. Such a system should keep the signage material as planar as possible, and not introduce a vacuum or partial vacuum underneath it, or cause air pockets to form underneath it either, at any point along the sign. Such a system would have its framing removable, and insure protrusion from the lateral surface of the vehicle low enough to comply with all regulatory maximum vehicle width specifications. Once the framing is removed, the visible resident should be at an absolute minimum, and the framing should be capable of replacement and removal at will, and in a short, less than half-hour, time frame. The system would also allow for insertion of the line by which the edges of the sign are anchored to the substrate to be flexible, allowing for pre-insertion at the time of manufacture, and easy transportation. The system would further include a positive locking mechanism which does not release even if the sign is torn. The locking mechanism should present a smooth exterior surface with no exposed fastening device to be more resistant to scraping. The attachment bead should be protected behind the exterior surface. The exterior sign should project no more than ¼ inch to avoid any problems with excess width.

The present invention meets these needs.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIGS. 8A–8F are exploded side views of the components of the present invention.

DETAILED DESCRIPTION OF THE INVENTION

Figure 1:
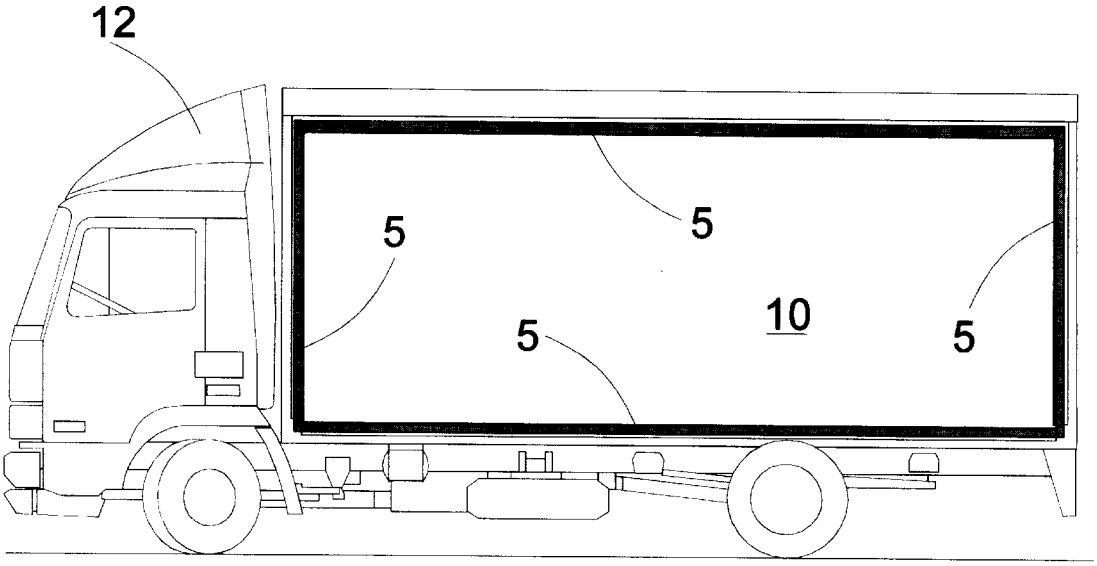
FIG. 1 provides a head-on view of the signage system fully installed and tensioned on the side of a truck.
Figure 2:
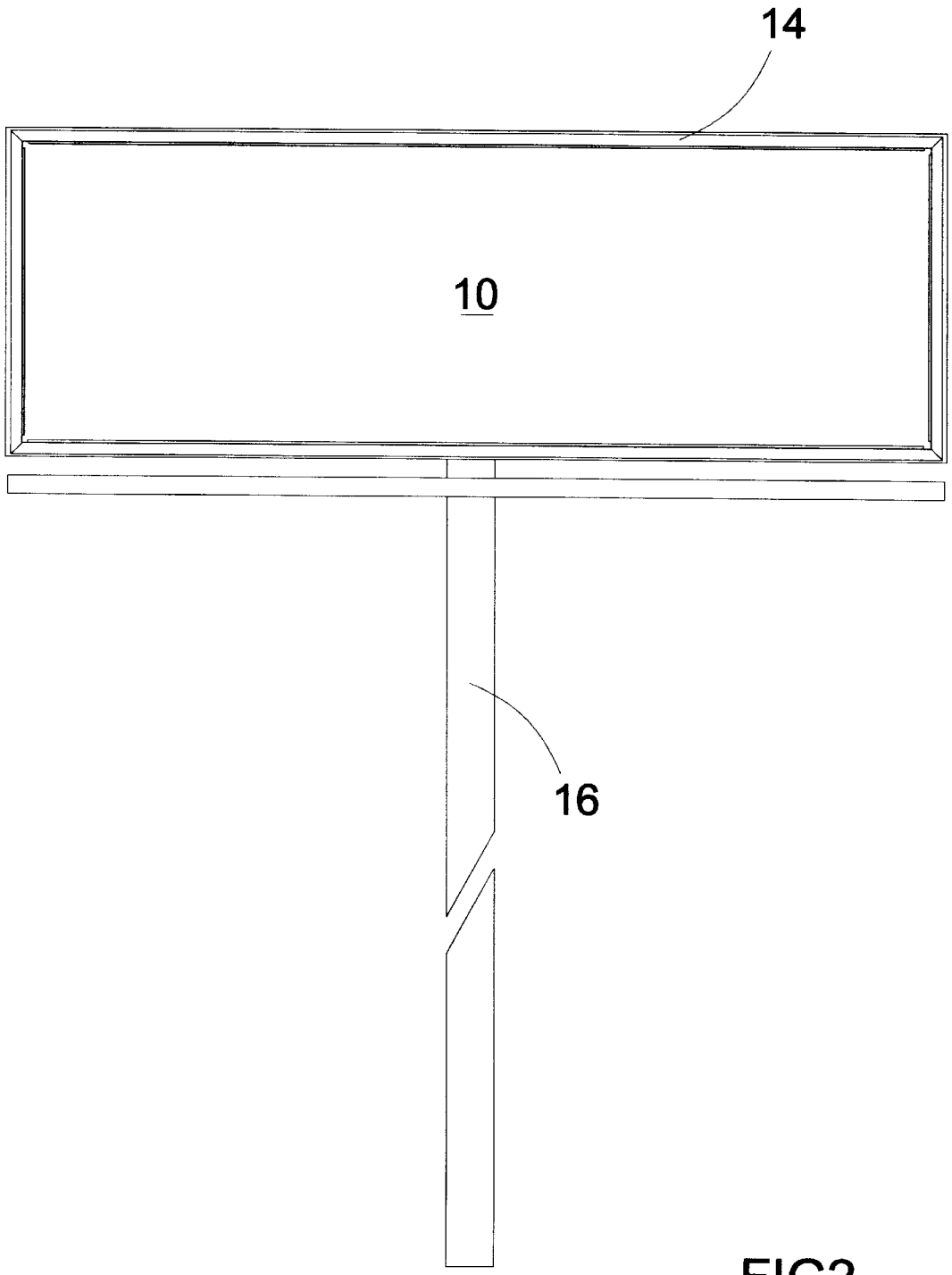
FIG. 2 is a head-on view of the signage system fully installed and tensioned on a fixed billboard.
Figure 4:
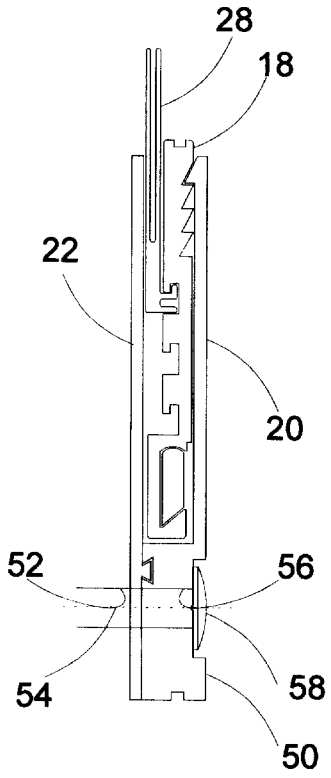
FIG. 4 is a cross sectional view taken along the section line 4—4 of FIG. 3.
Figure 3:
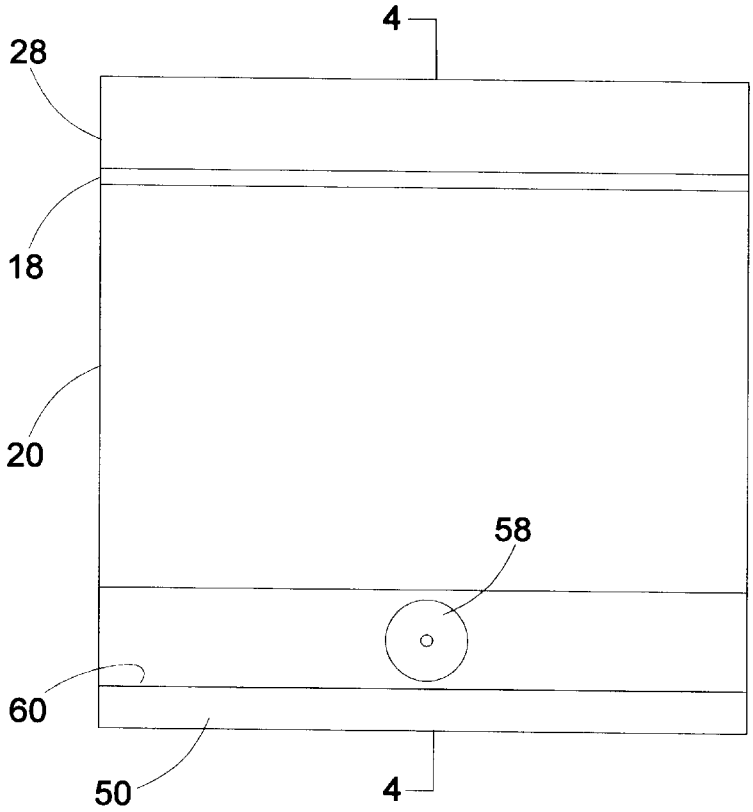
FIG. 3 shows a front view of a sign mounted on the side of a truck.

Referring to FIG. 1, a typical embodiment of the signage display system of the present invention is shown. A flexible sign 10 is held in place on the side of a transport vehicle 12 by a frame 14. The system is shown in FIG. 2 in another embodiment as installed on a fixed billboard type sign. In this implementation, frame 14 is manufactured of high strength aluminum, in other implementations they can be made of materials with similar functional properties.

FIGS. 3–8 show corresponding detailed views of the present improved display attachment system to attach the edges of the sign. As best seen in FIG. 8, the device comprises a channel insert 18, a mounting channel 20, an optional backing plate 22, an insertion bead 24 and an insertion strip 26. For some dimensional reference, the width of mounting channel extending from the truck 12 is preferably less than ¼ inch thereby minimizing wind drag and width issues.

Insertion bead 24 has two elongated legs 28 which extend from a base 30. Elongated legs 28 define a narrow, elongated u-shaped channel 32 therebetween. An edge of sign 10 is captured within said channel 32 as best seen in FIGS. 5–7.

Extending laterally from base 30 perpendicular to legs 28 are an upper prong 34*a* and a lower prong 34*b* having a slot 36 therebetween. Extending upwardly and rearwardly from upper prong 34*a* is a hook 38.

Channel insert 18 is provided with a plurality of generally rectangular cross sectioned recesses 40 on one side thereof. Recesses 40 are partially occluded by a retainer 42 extending downwardly from the opening of each recess 40. Each recess 40 corresponds in size generally to prongs 34*a* and 34*b* in combination when prongs 34 are fully inserted into any one of the recesses 40, the associated retainer 42 engages hook 38 to retain prongs 34 therein.

Prongs 34 are snap fit or slid into a recess 40 by simple pressure. When such pressure is applied, slot 36 narrows as prongs 34*a* and 34*b* resiliently approach one another thereby allowing prongs 34 to clear retainer 42. Once hook 38 clears retainer 42, slot 36 resiliently returns to its former width whereby hook 38 engages retainer 42 to retain prongs 34 within recess 40. Those skilled in the art will recognize that other snap fitting means are certainly possible for retaining a portion of base 30 to channel insert 18.

On the opposite side of channel insert 18 from recesses 40 are a plurality of generally right triangular slots 44 preferably positioned at the upper end of channel insert 18. Right triangular slots 44 mate with a corresponding right triangular post 46 provided on mounting channel 20. Again, those skilled in the art will recognize that additional means for retaining channel insert 18 within mounting channel 20 are possible.

Figure 5A:
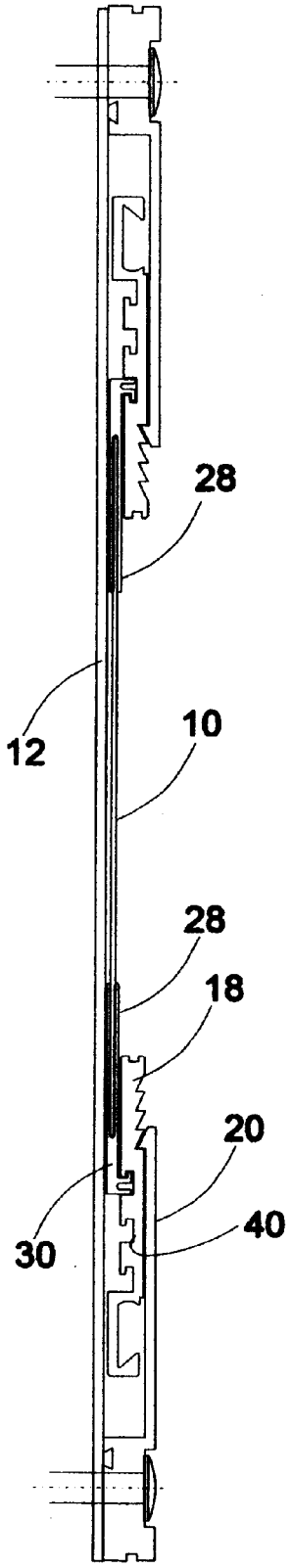
FIGS. 5A and 5B provide a cross sectional side view taken along line 5—5 of FIG. 2.
Figure 5B:
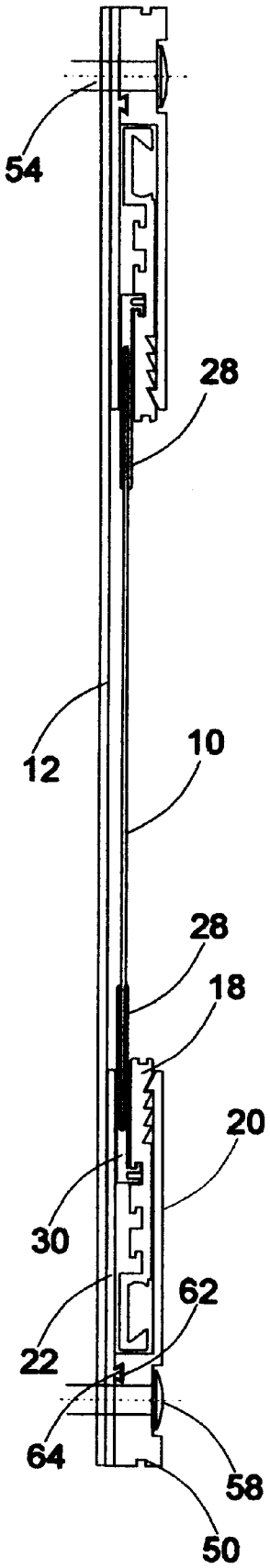
Figure 6A:
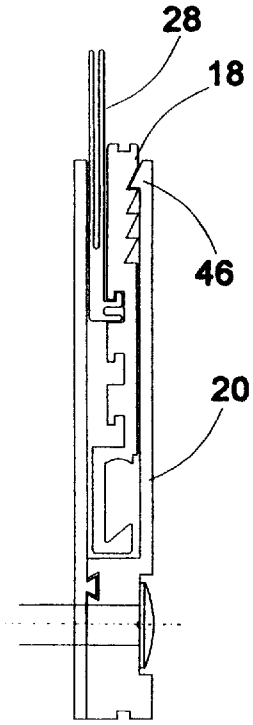
FIGS. 6A–6D provide a cross sectional side view showing one method of adjusting tension used in the present invention.
Figure 6B:
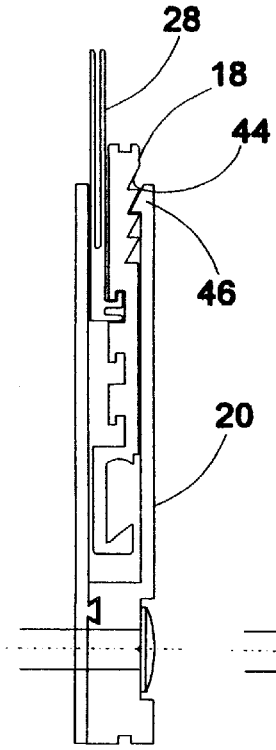
Figure 6C:
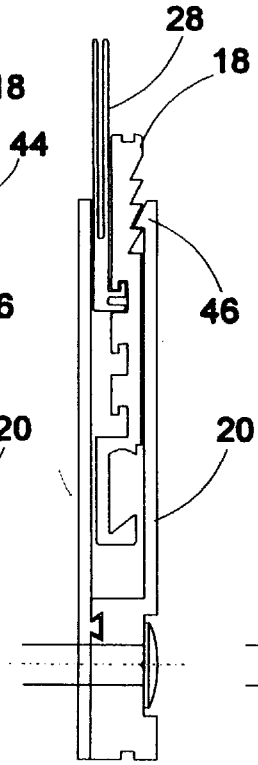
Figure 6D:
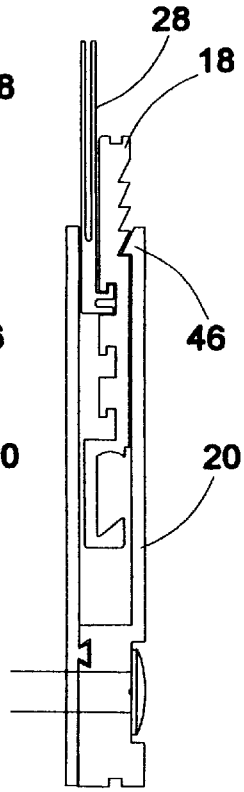
Figure 7A:
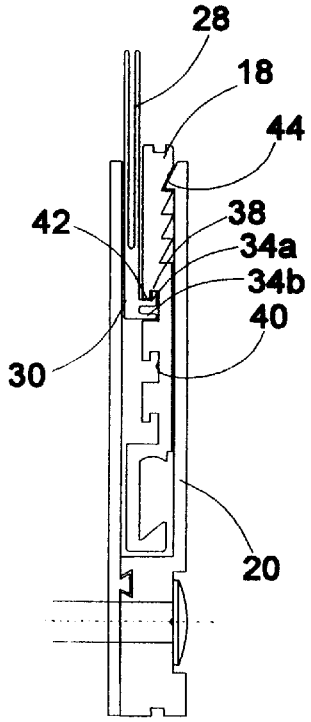
FIGS. 7A–7C provide a cross sectional side view showing another method of adjusting tension used in the present invention.
Figure 7B:
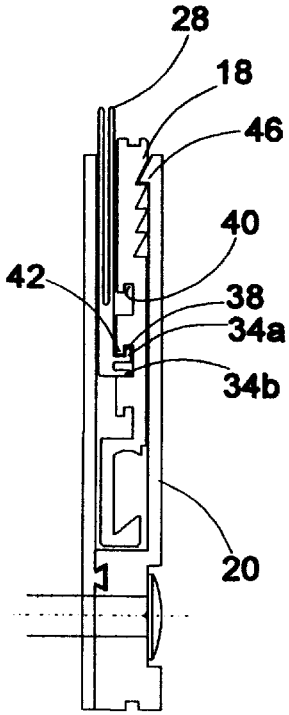
Figure 7C:
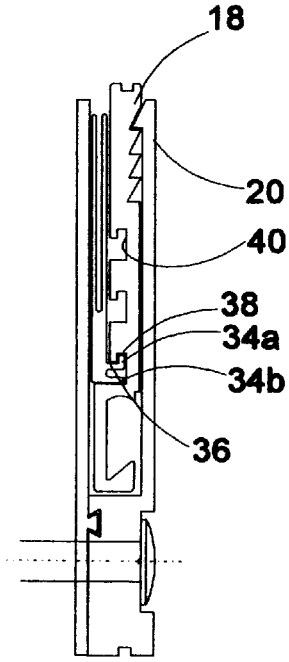

As best seen in FIG. 5, mounting channel 20 is L-shaped having a mounting leg 48, and a base 50. Backing plate 22 is preferably the same length as mounting channel 20. Backing plate 22 is mounted directly to truck 12. Alternatively, as shown in FIG. 5B, backing plate 22 can be omitted whereby mounting channel 20 is mounted directly onto truck 12 as shown in FIG. 5A. The lower portion of backing plate 22 provides a hole 52 which corresponds to a second hole 56 in base 50. A rivet 54 for attaching backing plate 22 and mounting channel 20 to the side of a truck extends through holes 52 and 56. Rivet 54 engages a rivet head 58 which, preferably, is mounted in a cavity 60 on mounting channel 20. Preferably, a dovetail guide post 62 mates with a corresponding dovetail cavity 64 to position backing plate 22 and mounting channel 20 properly.

Triangular post 46 is mounted proximate to the top of mounting leg 48. As best seen in FIGS. 4–7, the interior separation of mounting leg 48 and backing plate 22 corresponds to the width of channel insert 18 in combination with base 30 when prongs 34 are inserted into one of the recesses 40.

To use, as previously discussed, prongs 34 of base 30 are snap fitted into recesses 40 of channel insert 18. The size of channel insert 18 and base 30 combination is thereafter inserted between mounting channel 20 and backing plate 22 (or truck 12 if backing plate 22 is not utilized) until triangular post 46 engages one of triangular recesses 44 thereby retaining channel insert 18 therebetween. As shown, when the channel insert 18 and base 30 combination is so inserted, backing plate 22 (or truck 120 prevent prongs 34 from being withdrawn laterally from recesses 40. Thus, even if sign 10 is torn, the channel insert 18 and base 30 cannot be disengaged. Further, insertion bead 24 is completely covered thereby providing further protection to same.

As best seen in FIGS. 6A–6D and 7A–7C, the user can employ both the selection of one of the recesses 40 to insert prongs 34 and the selection of one of the triangular slots 44 to engage triangular post 46 to adjust the tension of sign 10. The tension adjustment can be made utilizing such tools as a pair of pliers. There are roller tools available which engage to top of insert 18 and the bottom of channel 20 simultaneously.

Figure 9:
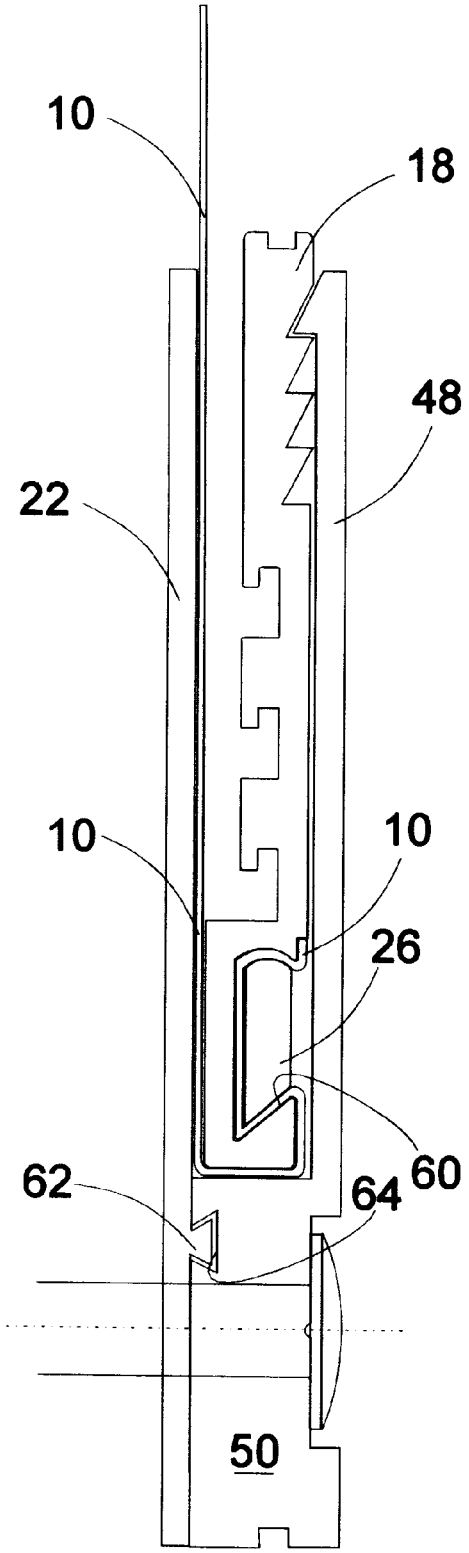
FIG. 9 shows an alternate method for attaching a sign using the present invention.

An alternate method of attaching sign 10 is illustrated in FIG. 9. This method avoids the need to capture sign 10 between legs 28 of insertion bead 24. Instead, an edge of sign 10 is threaded downwardly between a wide channel insert 18*a* and backing plate 22 (or the side of truck 12) laterally between insert 18*a* and to the top of base 50, and finally upwardly between insert 18*a* and mounting leg 48. On the side of channel insert 18*a* facing mounting leg 48, an insertion cavity 60 is provided which receives insertion strip 26 therein. Sign 20 is threaded about the periphery of insertion cavity 60 and retained therein by insertion strip 26. Strip 26 is preferably a flexible PVC material allowing it to snap or slide into cavity 60.

Both embodiments present a generally smooth exterior with no exposed fasteners. The smooth profile makes the device resistant to scraping.

Although only certain embodiments have been illustrated and described, it will be apparent to those skilled in the art that various changes and modifications can be made therein without departing from the spirit of the invention or from the scope of the appended claims.

That which is claimed is:

1. A signage display attachment system for mounting a sign to a substrate, the signage display attachment system comprising:

an insertion bead, the insertion bead having two elongated legs extending from an insertion bead base, the two elongated legs defining a narrow, elongated channel therebetween, the channel adapted to receive an edge of a sign therein, the insertion bead further having an upper prong and a lower prong extending laterally from the insertion bead base perpendicular to the legs, a slot formed between the upper prong and the lower prong, a channel insert having a plurality of recesses on one side thereof, the upper prong and the lower prong sized to be receivable in combination within one of the plurality of recesses, means for releasably retaining the upper prong and the lower prong, in combination, within each of the plurality of recesses, a mounting channel having a retainer leg and a mounting channel base, the channel insert interposed between the insertion bead and the retainer leg of the mounting channel, the mounting channel having means for mounting the mounting channel to a substrate, and means for releasably retaining the insertion bead and channel insert in combination between a substrate and the retaining leg.

2. The system of claim 1 wherein the means for releasably retaining the insertion bead and the channel insert in combination between a substrate and the retaining leg comprises:

a plurality of triangular slots positioned at the upper end of the channel insert opposite the one side having the plurality of recesses; and a corresponding triangular post inwardly facing and mounted proximate to the top of the retainer leg, the triangular slots mating with the triangular post.

3. The system of claim 1 wherein the means for mounting to a substrate comprises having the mounting channel base having a hole for placement of a corresponding rivet for attaching the mounting channel to a substrate.

4. The system of claim 1 wherein each of the plurality of recesses provides a rectangular cross section, wherein the means for releasably retaining the prongs within each of the recesses comprises a retainer extending downwardly across the opening of each recess, a hook extending upwardly and rearwardly from the upper prong, each recess being sized to receive the upper prong and the lower prong in combination whereby the retainer engages the hook to retain the prongs within each of the plurality of recesses when inserted therein.

5. The system of claim 1 further comprising a backing plate mounted on the mounting channel opposite the retaining leg, the backing plate being adapted to be mounted to a substrate.

* * * * *